United States Patent [19]

Burandt

[11] 4,438,735

[45] Mar. 27, 1984

[54] APPARATUS AND TIMING MECHANISM FOR CONTROLLING THE VALVE OPERATION OF AN INTERNAL COMBUSTION ENGINE

[75] Inventor: Corliss O. Burandt, Plymouth, Minn.

[73] Assignee: Investment Rarities, Incorporated, Minneapolis, Minn.

[21] Appl. No.: 310,637

[22] Filed: Oct. 13, 1981

[51] Int. Cl.[3] ..... F01L 1/34

[52] U.S. Cl. ..... 123/90.16; 123/90.31; 123/90.44

[58] Field of Search ..... 123/90.15, 90.16, 90.17, 123/90.27, 90.31, 90.39, 90.44

[56] References Cited

U.S. PATENT DOCUMENTS

| | | | |
|---|---|---|---|
| 2,260,983 | 10/1941 | Walker | 123/90.16 |
| 3,496,918 | 2/1970 | Finlay | 123/90.15 |
| 3,897,760 | 8/1975 | Hisserich | 123/90.16 |
| 3,986,484 | 10/1976 | Dyer | 123/90.15 |
| 4,174,683 | 11/1979 | Vivian | 123/90.15 |

*Primary Examiner*—Craig R. Feinberg

*Assistant Examiner*—W. R. Wolfe

*Attorney, Agent, or Firm*—Peterson, Palmatier, Sturm, Sjoquist & Baker, Ltd.

[57] ABSTRACT

The valve operating apparatus includes an upper and lower rocker arm for each valve to be controlled, each having a straight section and a curved section. The lower rocker arm is mounted at one end for pivotal movement about a fixed axis, its other end acting against the valve to be controlled. The upper rocker arm is mounted at one end for pivotal movement about a shiftable or movable axis. Depending on where the upper rocker arm has been shifted to in relation to the camshaft and concomitantly where the upper arm has been shifted in relation to the lower arm the lift and duration of valve opening is controlled. A timing mechanism is actuated by the valve operating apparatus so as to angularly displace the camshaft on which the above alluded to cam is mounted in a direction to advance or retard the valve opening and closing with respect to the crankshaft and hence in relation to the piston movement produced by the crankshaft.

4 Claims, 5 Drawing Figures

APPARATUS AND TIMING MECHANISM FOR CONTROLLING THE VALVE OPERATION OF AN INTERNAL COMBUSTION ENGINE

CROSS-REFERENCE TO RELATED APPLICATION

Subject matter herein referred to is more fully described in my co-pending application for "Variable Valve Operating Mechanism for Internal Combustion Engines", Ser. No. 310,655, filed Oct. 15, 1981, now U.S. Pat. No. 4,414,931.

BACKGROUND OF THE INVENTION

1. Field of the Invention

This invention relates generally to internal combustion engines, and pertains more particularly to apparatus for actuating the valves of an internal combustion engine and to a timing mechanism associated therewith, the valve actuating apparatus automatically causing the timing mechanism to adjust the valve timing in accordance with the valve actuation.

2. Description of the Prior Art

It has long been recognized that in order to derive maximum power from an internal combustion engine the intake and exhaust valves should not open and close exactly at dead center positions of the pistons with which they are associated. It is known that an early intake valve closing is desired at low speeds, but a later closing of the intake valves is desired at higher engine speeds. Also, a later opening of the exhaust valve helps to increase the power at low speeds, but on the other hand, an earlier opening of the exhaust valve enhances the power that is needed at top speeds. At most, valve timing in the past has been a compromise between low and high-speed operation.

SUMMARY OF THE INVENTION

My invention has for one important object the correlation and adjustment of the valve timing with actuating apparatus for controlling the opening and closing of the intake and exhaust valves. More specificially, an aim of the invention is to advance or retard the opening and closing of intake and exhaust valves with respect to the rotation of the engine's crankshaft and hence the piston movement derived from the rotation of the crankshaft. In this regard, it is within the purview of my invention to provide motor-operated apparatus for actuating the valves and also a timing mechanism that is automatically controlled in relation to the adjustment achieved with the valve operating apparatus.

A more specific object of the invention is to effect an automatic advance of the valve opening when the valve operating apparatus has increased the duration or period of valve opening because of an increased load condition imposed upon the engine, and to also retard the valve opening when the engine is experiencing a lighter load condition, this being done automatically when utilizing the teachings of my invention.

Briefly, my invention contemplates apparatus for actuating the valves of an internal combustion engine which includes a rocker arm having a contoured working surface, there being a rocker arm for each intake valve and a rocker arm for each exhaust valve. The rocker arm, in each instance, is engaged by a rotating cam carried on the camshaft so that the amount of valve lift can be changed and also the duration of valve opening can be controlled depending upon the particular load to which the engine is subjected at any given time. A valve timing mechanism is controlled by the valve operating apparatus so that the opening of the valves is advanced when there is a heavier load experienced by the engine, and the valve opening is delayed or retarded when there is a lighter load experienced by the engine. It is planned that an electric motor be controlled in accordance with engine conditions and that the same motor also adjust the timing mechanism in accordance with whatever adjustment is made by the motor so as to obtain the appropriate amount of valve lift and the proper duration of time that the valve is open as far as each cylinder is concerned.

DESCRIPTION OF THE PREFERRED EMBODIMENT

Figure 1:
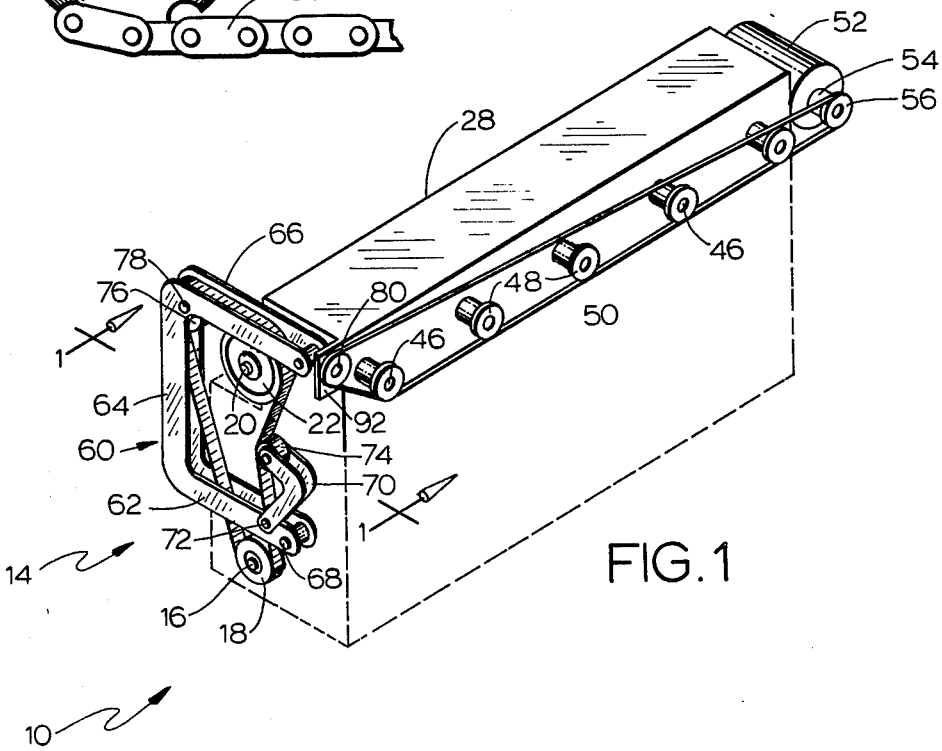
FIG. 1 is a highly diagrammatic view of an internal combustion engine utilizing my valve operating apparatus along with my valve timing mechanism that is automatically controlled thereby, the valve operating apparatus being concealed by reason of the valve housing.

Inasmuch as my valve operating apparatus is more fully disclosed in my co-pending application hereinbefore identified, only a brief description of the apparatus will be given in relation to the internal combustion engine which has been denoted generally by the reference numeral 10 in FIG. 1. The valve operating apparatus has been denoted generally by the reference numeral 12, whereas my timing mechanism, which is controlled by the valve operating apparatus 12, has been indicated by the reference numeral 14.

It will be well to refer to component parts comprising the internal combustion engine 10 that are conventional, but nonetheless will help the reader to appreciate the benefits to be derived from a practicing of my invention. In this regard, it is to be noted that one end of a conventional crankshaft 16 appears in the lower portion of FIG. 1, having a timing gear or sprocket 18 mounted thereon, the member 18 being shown as a pulley for drafting simplicity and because of the relatively small scale of FIG. 1. One end of a conventional camshaft 20 appears in the upper portion of FIG. 1, having a timing gear or sprocket 22 mounted thereon, the member 22 also being shown as a pulley. The function of the timing mechanism 14 is to angularly shift or displace the upper timing gear 22 relative to the lower timing gear 18; this will be explained hereinafter.

At this point, it will be well to describe briefly other components of the engine 10 with which my valve operating apparatus 12 is associated. Thus, it will be discerned that the camshaft 20, which is driven from the engine 10, more specifically from the timing gear 18, has a number of cams 24, **24*a* thereon, the number depending upon the number of cylinders or combustion chambers that the engine 10 has. It will be assumed that the engine 10 is a four cylinder engine. However, only one intake valve 26 will be referred to and only one exhaust valve 26***a* will be mentioned. Portions of the valves 26, 26*a* appear in FIG. 2. However, an inlet valve is more fully illustrated in my co-pending application, supra. Of course, there would be four such intake valves 26 and four such exhaust valves 26*a* for the illustrative four cycle engine 10. The valve operating apparatus includes a valve housing denoted generally by the reference numeral 28.

Figure 2:
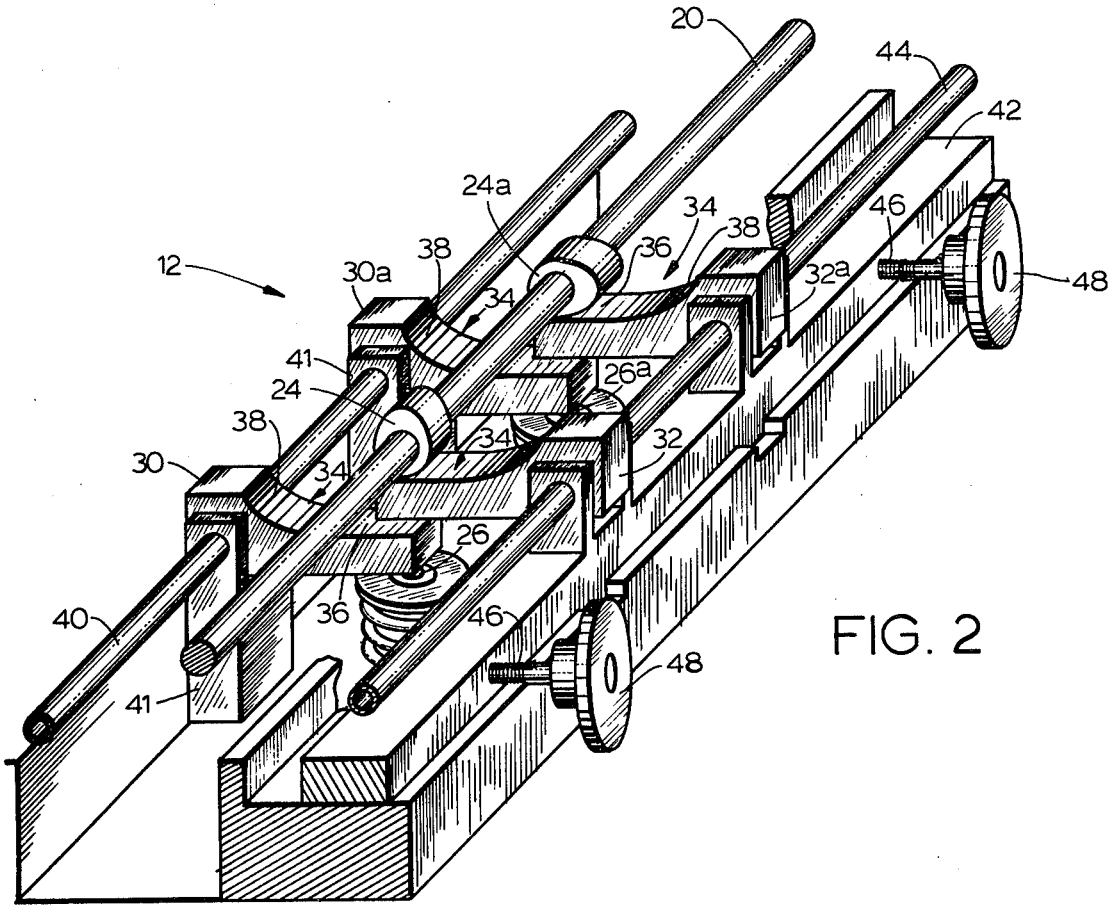
FIG. 2 is an enlarged perspective view of my valve operating apparatus for controlling an inlet valve and an outlet valve associated with one cylinder of the engine shown diagrammatically in FIG. 1.
Figure 4:
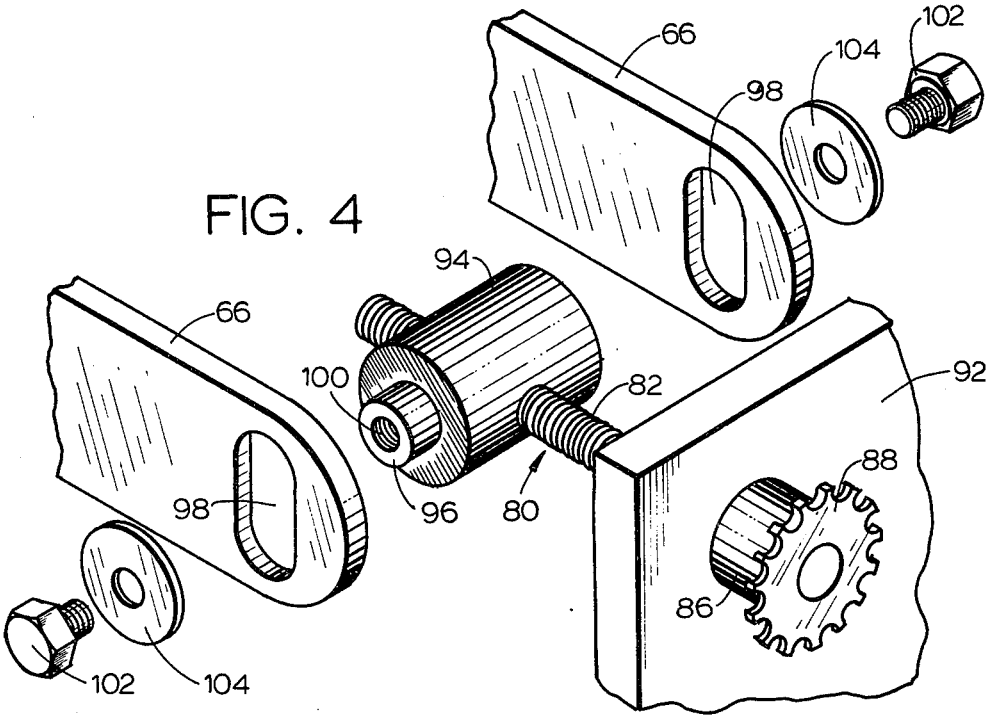
FIG. 4 is an exploded detail view of a portion of my timing mechanism.

Two rocker arms 30, 32 are included in my apparatus 12 and function to actuate the inlet valve 26. These rocker arms 30, 32 may be replicas of each other and are more fully described in my said co-pending application. It should be noted that each rocker arm 30, 32 is formed with a working or cam follower surface 34 composed of a straight section 36 and a curved section 38. The working surface 34 of the rocker arm 32 is engaged by the cam 24, as can be seen in FIG. 2, the particular portion of either the section 36 or 38 that is engaged depending on where the upper rocker arm 32 is positioned relative to the cam 24. The lower and upper rocker arms for the exhaust valve 26*a* in FIG. 2 have been given the reference numerals 30*a* and 32*a*, respectively.

Each lower rocker arm 30, 30*a*, and there would be a total of eight such rocker arms for the four cylinder engine 10 that has been selected to exemplify my invention, is mounted for rotation about a fixed axis. On the other hand, each upper rocker arm 32, 32*a* is mounted on a shiftable axis.

The tubular shaft furnishing the fixed axis for the lower rocker arms 30, 30*a* has been given the reference numeral 40 in FIG. 2. The manner in which the tubular shaft 40 is fixedly mounted within the housing 28 is susceptible to some choice; a plurality of fixed blocks 41 have been shown in FIG. 2. While the shaft 40 itself is fixedly mounted, it will be appreciated that each rocker arm 30, 30*a* is pivotally mounted on this shaft 40.

However, there is an elongated block 42, a portion of which appears in FIG. 2, that mounts a second tubular shaft 44 that provides a shiftable axis for the various upper rocker arms 32, 32*a*. The actual shifting of the tubular shaft 44 is effected via a number of threaded shafts 46 that threadedly engage spaced portions of the elongated block 42. From FIG. 1, it will be perceived that there are five such threaded shafts 46.

Each threaded shaft 46 has a pulley or a sprocket 48 thereon which enables the shafts 46, by means of a chain 50, to be rotated in unison to shift the block 42. Since the upper rocker arms 32, 32*a* are pivotally mounted on this block 42, the arms 32, 32*a* are shifted so that the cams 24, 24*a* on the camshaft 20 engage portions of either the straight section 36 or portions of the upwardly curved section 38 of the working or cam follower surface 34.

It will be observed that the valve housing 28 has an electric motor 52 mounted thereon, the motor 52 having a drive shaft 54 with a pulley or sprocket 56 thereon. The belt or chain 50 is entrained about the five pulleys or sprockets 48 and about the drive pulley or sprocket 56. The manner in which the motor 52 is operated need not be described in detail; resort can be made to my co-pending application for a schematically presented way in which the motor 52 can be energized to control the opening and closing of the valves 26, 26*a*.

From the foregoing description, even though somewhat abbreviated, it should be appreciated that when the motor 52 is energized to cause the rocker arm 32 to be moved from a position in which the cam 24 engages the straight section 36 of the working surface 34 to a position in which the cam 24 engages the upwardly curved section 38 of this working surface 34, the lower rocker arm 30 is forced downwardly for a longer period during each rotation of the camshaft 20, because engagement between the cam 24 and the working surface 34 of the arm 32 is maintained for a longer period of time. Consequently, the valve 26 will be opened for a longer period of time; not only that, but its lift or downward travel will be increased by reason of the increased moment arm existing under these circumstances by virtue of the end of the upper rocker arm 32 being positioned nearer the fixed pivotal axis provided by the tubular shaft 40. It should be apparent that when the valve duration is increased, as is needed when the load on the engine 10 is increased, then a greater charge or mixture of fuel and air is permitted to enter each cylinder or combustion chamber of the engine 10.

Figure 3:
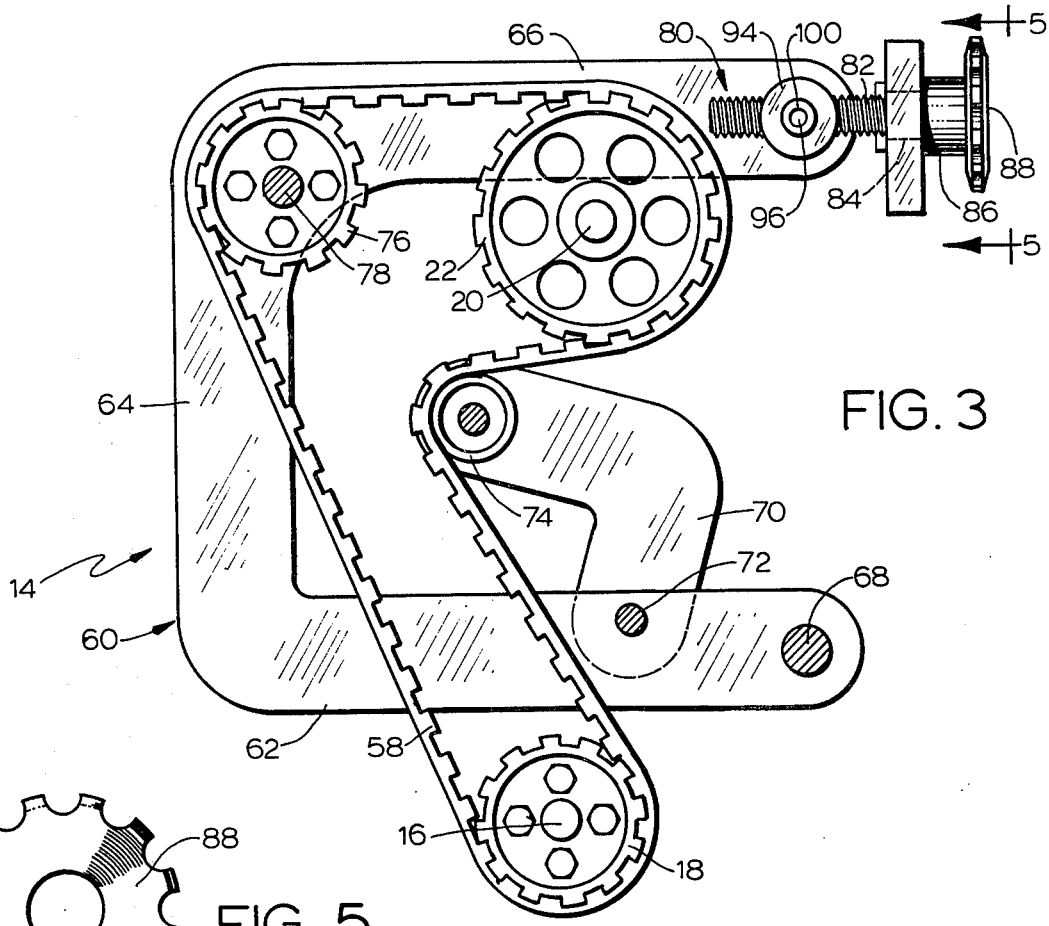
FIG. 3 is a view, partly in section, of the timing mechanism, the view being taken in the direction of line 3—3 of FIG. 1.
Figure 5:
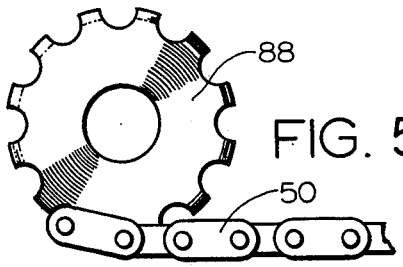
FIG. 5 is a fragmentary detail taken in the direction of line 5—5 of FIG. 3.

In order to control the time at which the valve 26 opens, my timing mechanism 14 is employed. It is operated or controlled by the valve operating apparatus 12. The timing mechanism 14 comprises a pair of identical U-shaped members 60, the members 60 being slightly spaced with respect to each other as can be understood from FIG. 1. It should be taken into account, though, that the view constituting FIG. 3 is taken in a plane that eliminates one of the U-shaped members 60, this being the one that is closer to the viewer when looking at FIG. 1.

Describing the U-shaped members 60 with greater particularity, it is to be noted that each includes a generally horizontal leg portion 62, an upwardly extending vertical leg portion 64 and an upper generally horizontal leg portion 66 that is parallel to the lower leg portion 62. The lower leg portions 62 are pivoted at their right ends by means of a pivot pin 68 which is simply mounted in the illustrative situation of a bracket (not shown) attached to the engine 10, more specifically the cylinder block.

The lower leg portions 62 carry a pair of L-shaped arms 70 that are pivotally connected to the lower leg portions 62 by means of a pivot pin 72 extending therethrough, the pivot pin 72 being somewhat to the left of the pivot pin 68 mounting the U-shaped members 60 to the engine 10. The other ends of the L-shaped arms 70 support a rotatable idler pulley or sprocket 74 that bears against a section of the belt or chain 58 that spans the distance between the timing gears 18 and 22. It will be recognized that in practice the L-shaped arms 70 are spring-biased in a counterclockwise direction so as to force or urge the idler pulley or gear 74 against the belt or chain 58 to maintain this endless member taut.

Additionally, an additional pulley or sprocket 76 is mounted for rotation on a pin 78 extending between the U-shaped members 60 at the junction of their vertical leg portions 64 and their upper horizontal leg portions 66. It should be recognized that the stretch or span of the timing belt or chain 58 extending directly between the lower crankshaft pulley or sprocket (or timing gear) 18 and the additional pulley or sprocket 76 just mentioned is maintained at a constant length.

On the other hand, the stretch or span of the timing belt or chain 58 extending between the additional pulley or sprocket 76 and the pulley or sprocket (or timing gear) 22 on the camshaft 20 is changed in length, the change in the length causing either an angular advancement or retardation of the camshaft 20 relative to the crankshaft 16.

To achieve the foregoing adjustment, the mechanism 14 further includes a shaft 80 having a threaded portion 82, a first shoulder portion 84 and a second larger shoulder portion 86, the larger shoulder portion having a pulley or sprocket (shown as a sprocket) 88 integral therewith. The smaller diameter shoulder portion 84 is received in an aperture formed in a bracket 92 projecting from the engine 10, actually from the valve housing 28. It is the pulley or sprocket 88 that has the previously mentioned belt or chain 50 extending thereabout so as to cause the last-mentioned pulley or sprocket 88 to be rotated when the motor 52 is energized.

Continuing with the description of the timing mechanism, it will be observed that the threaded portion 82 of the shaft 80 is threadedly received in a cylindrical barrel 94 which has oppositely issuing pintles 96, one pintle being received in a slot 98 provided in one of the upper horizontal leg portions 66 and the other pintle 96 being similarly received in the other leg portion 66. Each of the oppositely issuing pintles 96 has a tapped hole 100 into which a bolt 102 is threaded, there being a washer 104 that encircles the ball 102 and bears against the surface of the leg portion 66 lying adjacent the slot 98. In this way, swivel movement is provided for.

From the preceding description, it should be recognized that the U-shaped members 60 are rocked about the pivot pin 68 when the threaded shaft 80 is rotated in either direction. It is this rocking action, owing to the mounting of the pulley or sprocket 76 at the juncture of the vertical and horizontal leg portions 64, 66 that determines the time relationship between the crankshaft pulley or sprocket (or gear 18) and the camshaft pulley or sprocket (or gear) 22.

It should be noted that the rocking action referred to above advances the timing when the U-shaped members 60 are rocked in a counterclockwise direction and retarded when these members 60 are rocked in a clockwise direction. Stated somewhat differently, with the timing gear or pulley 18 rotating in a counterclockwise direction, any movement of the pulley or sprocket 76 to the left effects a relative angular displacement of the camshaft 20 in a counterclockwise direction relative to the crankshaft 16. Movement of the pulley or sprocket 76 to the right causes just the opposite to take place.

In summation, it should be understood that when the electric motor 52 is energized so as to rotate the five threaded shafts 46 in a direction to increase the duration that the valve 26 is open, thereby enabling a greater charge or mixture of fuel and air to enter the particular cylinder with which this valve is associated, there is a corresponding adjustment effected via the pulley or sprocket 76 associated with the timing mechanism 14 which causes an angular displacement of the camshaft 20 in a direction to cause the valve 26 operated by the cam 24 carried on the camshaft 20 to open earlier with respect to the rotation of the crankshaft 16. Inasmuch as the manner in which the crankshaft 16 reciprocates the pistons up and down within the various cylinders of the engine 10 is well known, no real need exists, it is believed, to show the various pistons, connecting rods and crankarms associated with the crankshaft 16. All that need be appreciated is that the camshaft 20 is adjusted angularly while it is rotating with respect to the crankshaft 16. Inasmuch as the pistons are moved in accordance with the rotation of the crankshaft 16, the resulting valve adjustment is with respect to the position of the various pistons within their respective cylinders, all as controlled by my valve operating apparatus 12 and the timing mechanism 14 controlled thereby.

I claim:

1. In combination with an internal combustion engine including a crankshaft, a first timing member mounted for rotation with said crankshaft, a camshaft, a cam on said camshaft, a second timing member mounted for rotation with said camshaft, an endless member entrained about said first and second timing members, a third rotatable member about which said endless member is also entrained, means shifting said third member toward and away from said second member to angularly displace said second member and said camshaft relative to said first member and said crankshaft, a rocker arm having a straight cam follower surface and a curved cam follower surface, and means interconnected with said shifting means for simultaneously moving said rocker arm to shift said cam follower surfaces in accordance with the shifting of said third member toward and away from said second member.

2. The combination of claim 1 in which said internal combustion engine has an inlet valve, means controlling the period said inlet valve is open, said last-mentioned means also controlling said means for shifting said third member.

3. In combination, a rotatable camshaft, a cam on said camshaft, valve operating apparatus including a rocker arm having a nonlinear cam follower surface engageable by said cam for varying the timing of the opening of a valve associated with an internal combustion engine depending upon the relative position of said cam follower surface with respect to said cam, a first threaded member for shifting said rocker arm for adjusting the timing of said valve opening, and a valve timing mechanism controlled by said valve operating apparatus for adjusting the timing of said valve opening in accordance with the opening of said valve as determined by the relative position of said cam follower surface with respect to said cam, said timing mechanism including a second threaded member for adjusting said timing, and means interconnecting said threaded members so that said valve operating apparatus controls said timing mechanism.

4. The combination of claim 3 in which said rocker arm is shiftable by said first threaded member in accordance with the amount said first threaded member is rotated to change the relative position of said cam follower surface with respect to said cam, and said timing mechanism includes a U-shaped member shiftable by said second threaded member in accordance with the amount said second threaded member is rotated via said interconnecting means.

* * * * *